US010442617B1

(12) United States Patent
Holbrook

(10) Patent No.: US 10,442,617 B1
(45) Date of Patent: Oct. 15, 2019

(54) MULTI-RING PLASTIC STORAGE TANKS AND RISERS

(71) Applicant: Infiltrator Systems, Inc., a Connecticut corporation, Old Saybrook, CT (US)

(72) Inventor: Paul R. Holbrook, Old Saybrook, CT (US)

(73) Assignee: INFILTRATOR WATER TECHNOLOGIES LLC, Old Saybrook, CT (US)

( * ) Notice: Subject to any disclaimer, the term of this patent is extended or adjusted under 35 U.S.C. 154(b) by 0 days.

(21) Appl. No.: 14/444,960

(22) Filed: Jul. 28, 2014

Related U.S. Application Data

(60) Provisional application No. 61/858,768, filed on Jul. 26, 2013.

(51) Int. Cl.
*E03F 3/04* (2006.01)
*E03F 5/02* (2006.01)
(Continued)

(52) U.S. Cl.
CPC ..... *B65D 90/023* (2013.01); *B65D 21/0234* (2013.01); *B65D 88/025* (2013.01); *B65D 90/08* (2013.01); *B65D 90/105* (2013.01); *B65D 21/0209* (2013.01); *E02D 29/121* (2013.01); *E03F 5/02* (2013.01); *E03F 11/00* (2013.01)

(58) Field of Classification Search
CPC ..... B65D 90/02; B65D 90/08; B65D 90/023; B65D 90/024; B65D 90/025; B65D 90/026; B65D 21/0234; B65D 88/025; B65D 88/526; B65D 88/528; B65D 21/08; B65D 21/083; B65D 21/086; B65D 90/105; B65D 21/0209; B65D 2519/00945; E03F 11/00; E03F 5/00; E03F 5/02; E03F 5/024; E03F 2005/028; B60K 2015/03164; B60K 2015/03171; E02D 29/12; E02D 29/121; E02D 29/1409; F16L 47/10
USPC ..... 220/4.16, 4.26, 4.03, 691; 52/20, 79.3, 52/223.5; 285/420, 921, 110, 111
See application file for complete search history.

(56) References Cited

U.S. PATENT DOCUMENTS 2,873,881 A * 2/1959 Nichols ..... B65D 25/48 220/4.03
3,412,891 A 11/1968 Bastone et al.
(Continued)

FOREIGN PATENT DOCUMENTS

| | | |
|---|---|---|
| DE | 9407303 | 2/1994 |
| EP | 0631019 A1 | 3/1993 |
| FR | 2509343 A | 1/1983 |

OTHER PUBLICATIONS

Pat Base Machine Translation FR2509343 A.
(Continued)

*Primary Examiner* — Andrew D Perreault
(74) *Attorney, Agent, or Firm* — C. Nessler

(57) ABSTRACT

A plastic article useful as a riser for a septic tank or as a water tank article is comprised of a multiplicity of plastic rings which are attached vertically to each other at joints. Ring pairs which alternately have inward and outward sloping conical walls nest within each other for shipment or storage. A lid is shaped for use with the topmost ring to cover the opening irrespective of which conical shape the ring has.

9 Claims, 10 Drawing Sheets

(51) Int. Cl.

| | |
|---|---|
| ***E03F 3/06*** | (2006.01) |
| ***B65D 90/02*** | (2019.01) |
| ***B65D 90/08*** | (2006.01) |
| ***B65D 21/02*** | (2006.01) |
| ***B65D 90/10*** | (2006.01) |
| ***B65D 88/02*** | (2006.01) |
| *E02D 29/12* | (2006.01) |
| *E03F 11/00* | (2006.01) |

(56) References Cited

U.S. PATENT DOCUMENTS 3,645,547 A * 2/1972 Glover ..... F16L 47/10 277/619
3,658,176 A 4/1972 Reid
4,040,372 A * 8/1977 Flanders ..... B21D 51/20 29/525.04
4,206,845 A * 6/1980 Christian ..... A47G 19/26 206/508
4,566,704 A * 1/1986 van Dongeren .... B29C 45/1676 277/624
4,742,934 A * 5/1988 Michaud ..... B65D 1/34 220/784
4,852,757 A * 8/1989 Gold ..... B65D 21/083 220/4.03
5,378,357 A 6/1995 Houck et al.
5,839,844 A 11/1998 Nichols et al.
5,923,819 A 7/1999 Ross et al.
6,328,890 B1 12/2001 Thibault
6,602,023 B2 8/2003 Crescenzi et al.
6,986,227 B1 1/2006 Gavin
7,273,330 B1 9/2007 Brochu
7,574,831 B2 8/2009 Meyers
7,854,338 B2 12/2010 Graf
7,926,510 B1 4/2011 Terry, III et al.
8,757,453 B1 * 6/2014 Olsson ..... B65D 25/48 220/700
2005/0103694 A1 5/2005 Rost et al.
2008/0267709 A1 10/2008 Terry
2011/0168721 A1 7/2011 Waite et al.
2013/0336723 A1 * 12/2013 McKinney ..... E02D 29/12 405/129.55

OTHER PUBLICATIONS

English Translation,Abstract for EP0631019 A1.
English translation, Abstract for FR2509343.
English translation, Abstract for DE9407303.

* cited by examiner

MULTI-RING PLASTIC STORAGE TANKS AND RISERS

This application claims benefit of provisional patent application Ser. No. 61/858,768, filed Jul. 26, 2013.

TECHNICAL FIELD

The present invention relates to cylindrical molded plastic structures comprised of interlocked rings, in particular to sleeves which can be buried in soil for access to subterranean thinks, such as septic tanks or sewer lines, or which can be used as tanks for holding water and other liquids.

BACKGROUND

The present invention is concerned with providing "knock down" cylindrical-conical structures such as water tanks and risers which can be assembled from rings to provide a desired length or height, and which are adaptable to having closures or lids. As is well known, when a generally tubular structure is constructed in such a knock down way, the costs of storage and shipping can be reduced.

A riser for a plastic or concrete septic tank used in wastewater treatment is one application for such structures. The purpose of the riser is provide a space which extends upwardly from the access port of a septic tank to, or near to, the surface of the soil in which the tank is buried. A riser is supposed to keep surface water and soil from entering the port of the tank. Thus the joints between rings should have seals or other means aimed at preventing the passage of water. A similar requirement is presented in connection with a hole in earth that provides access to a sewer line or other buried things by means of a manhole. A casing or liner, sometimes referred to as a chimney, surrounds the manhole opening to maintain the hole within the earth. When such casings are made of plastic segments connected end-to-end, they present the same essential needs attending risers. In the present description the term riser shall be construed to embrace structures which are of the nature of manhole casings.

The riser should have a minimum diameter which is no less than the diameter of the access port on the top of a septic tank, which commonly is of about 60 cm. In the past such risers have been provided either as a one piece structure, or as a multiplicity of circular rings which are commonly screwed or bolted to each other to form the desired height assembly. Good fit and seal between the joints of the rings is desirable, with of course minimum labor of assembly. A riser should present an uppermost surface suitable for a lid with a good seal, particularly under conditions where surrounding soil may be prone to intruding into the seal region, as can occur when a lid is removed for septic tank maintenance purposes.

The present invention is also concerned with plastic tanks in the form of vertical cylinders for holding unpressurized water and other liquids. For example, a plastic tank may be used for storing water for domestic use. Distributors of tanks desire to provide users with different volume tanks. One way of achieving that is to form a tank from assembled components, similar to the way in which risers are made, and to provide a base closure.

Most commercially available risers are essentially short straight cylinders. Thus they cannot be conveniently nested for economic shipment and storage. Water tanks, for instance common bucket like tanks, often have tapered walls for easy nesting and shipment. However, it is an ongoing problem with respect to how to effective combine the principle of nesting tapered structures with the need for different length cylindrical structures which have substantially the same opening at the upper end as at the lower end, all the while getting good seals.

SUMMARY

An object of the invention is to provide molded plastic risers and water storage tanks in forms which are economical to manufacture, ship, and store. A further object is to provide a riser comprised of a multiplicity of rings having good joints, where the uppermost ring of an assembly is configured to receive a lid having a plain gasket.

In accord with the invention a riser for a septic tank or a tank for storing water is comprised of a multiplicity of rings. Each ring has a sloping wall and an upper end which is suited to form a joint with the lower end of a like-ring. Preferably, the rings have walls which slope at 10 to 20 degrees to the vertical axis of a ring and they may be nested one within the other for economical shipment.

In an embodiment of the invention, the upper end of a ring has a lip which is received and captured in a groove of the lower end of a like ring; and, a seal, such as an O-ring seal, is optionally present within the groove, to better provide a water-seal between mating rings.

In further accord with the invention, rings are mated first as pairs: a first ring has a conical wall which slopes outwardly as it runs from a lower end to an upper end, and a second ring has a conical wall which slopes inwardly as it runs from a lower end to an upper end. Additional rings may be connected to the assembly. Rings have joint fittings at the ends and preferably include mutual engagement features. The joint fittings allow the rings to connect to each other to form a riser or tank having an undulating or zigzag contour wall in the vertical direction. The conical shapes and fitting configurations enable the rings to nest well for compact storage and shipment.

When the assembled rings are used as part of a water storage tank, there is a closure across the opening of the bottommost ring. When used as a riser, the bottommost ring is attached usually by means of an adapter to the flange of a septic tank.

A particular lid may be placed on the top of the uppermost ring of a tank or riser. In embodiments of the invention, the joint fitting at the upper end of each ring comprises a portion, such as a flat surface running perpendicular to the vertical axis of the ring that is shaped to engage a lid that covers the top opening of the assembly. The same lid may be used as a cover for either of the rings of a ring pair comprised of an inward sloping wall ring and an outward sloping wall ring, even though the top opening of the rings is of different diameter.

The foregoing and other objects, features and advantages of the present invention will become more apparent from the following description of preferred embodiments and accompanying drawings.

DESCRIPTION

The present invention relates to articles which are comprised of rings that can be assembled one upon the other to form a vertical assembly with circumferential seals. For simplicity of verbiage in this description, the rings and assembled structures are often characterized as being cylindrical. As will be seen, some embodiments have inward or outward tapering walls, i.e., conical walls; those articles shall be comprehended by the term "cylindrical" and its variations. While the invention is described in terms of circular rings, features of the invention may be embodied in tanks and risers which are non-circular.

The invention is described with concentration on two exemplary products and applications, namely a riser for a septic tank and a water tank. When an open ended hollow article made in accord with the invention is fitted with a bottom closure that serves to convert a riser to a vessel which is a tank suitable for storing water or other liquids. Structures within the scope of invention can be put other uses including, for example, sleeves for manhole access to other subterranean things. A reference to a riser shall be construed as comprehending a casing which is used for a manhole in the earth or other material.

FIGS. 1 to 4 describe the construction of an exemplary tank. For this and other embodiments it should be understood that an alternative embodiment to any tank comprises the same assembly with the bottom closure omitted, so the structure may be useful as a riser. Conversely, when a riser embodiment is shown, when a closure is put on the bottom the structure will be useful as a tank.

Figure 1:
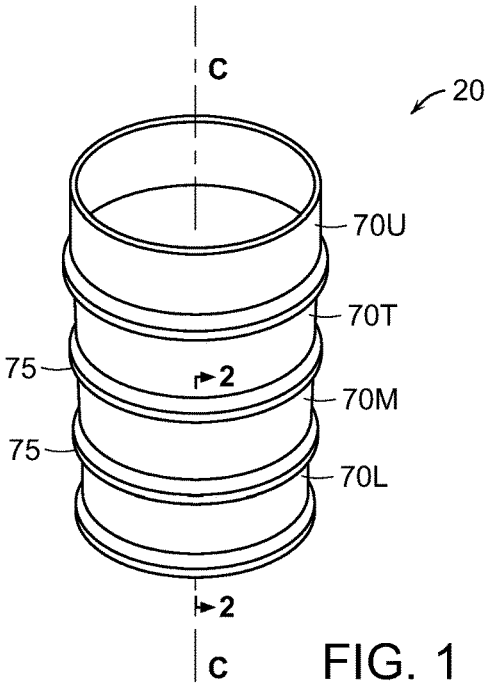
FIG. 1 is an isometric view of a riser comprised of a multiplicity of rings.

FIG. 1 is a perspective view of tank 20 which is comprised of a multiplicity of vertically interconnected rings 70, each having a common central vertical axis C-C. (In this description, where similar parts have a number with a letter suffix, a reference to the number element is a reference to all the letter-suffix elements in the pertinent Figure. Thus a reference to rings 70 is a reference to all the rings 70L, 70M, 70T, 70U in FIG. 1.)

Figure 2:
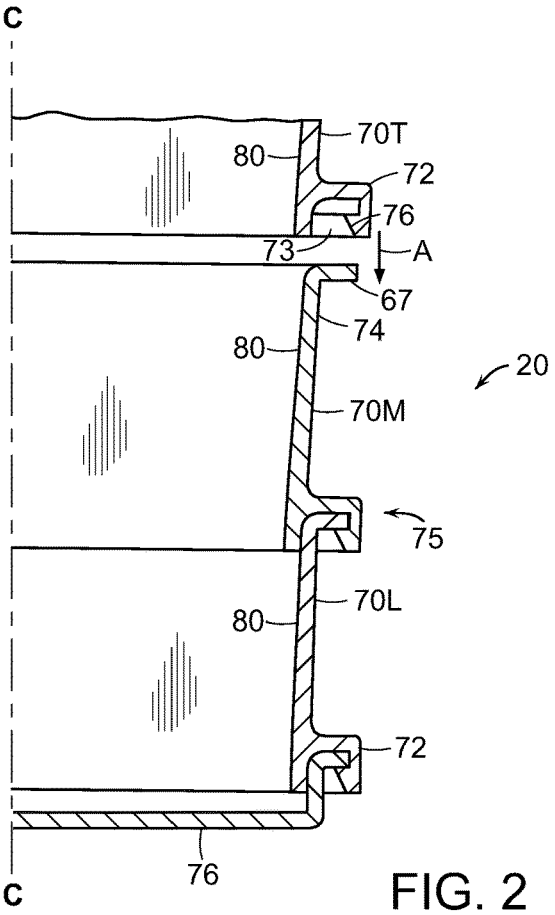
FIG. 2 is a vertical half-cross section of the riser of FIG. 1 with addition of a bottom closure to thereby form a tank comprised of rings which are interconnected at joints; one ring is shown in exploded fashion.
Figure 3:
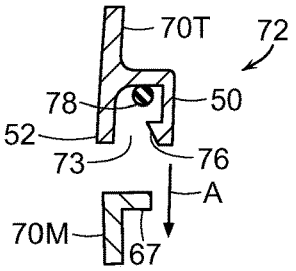
FIG. 3 is a detail of the joint between rings of the tank of FIG. 2, showing the mating engagement of the joint fittings.
Figure 3A:
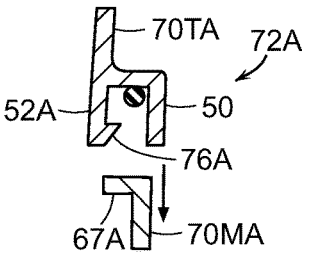
FIG. 3A is a detail like FIG. 3, showing an alternative joint engagement configuration.

FIG. 2 is a partial vertical cross section through the tank of FIG. 1, showing one embodiment of joint design. FIG. 3 is a detail cross section view of the joint between mating parts, with the addition of a seal not shown in FIG. 1 and FIG. 2. FIG. 3A shows a variation on the joint of FIG. 3.

In FIG. 2, the upper ring 70T of tank 20 is shown as it is about to be mated with underlying ring 70M, as indicated by the arrow A. The middle ring 70M is attached to the bottom ring 70L at typical joint 75. The bottom ring 70L is attached to base 76, which provides a closure of the bottom opening of the ring. When there is no closure, the structure 20 is suitable for use as a riser. Additional rings 70 may be added to the top ring 70U, to form a tank or riser having a desired volume. A lesser number of rings may be used.

With reference to FIG. 2 and the detail in FIG. 3, each ring 70 has a lower end 72 which comprises an inner skirt and an outer skirt, which skirts define the sides of a female cavity, namely circular groove 73, within which is received the lip 67 that comprises the joint fitting at the upper end 74 of ring 70, for forming a joint 75. The circumferential portions of a ring which are shaped for receiving and engaging a mating ring is referred to here as the joint fitting of the ring. As described below, particular joint fittings comprise surfaces for sealingly mating with a lid.

Each ring 70 comprises a circular wall 80 which at least has injection molding draft of one or more degrees, preferably 2 to 6 degrees. Circumscribing ridge 76 runs around the interior of outer skirt 50 that with inner skirt 52 defines groove 73 at lower end 72 of a ring 70, those elements comprising the fitting at the lower end of the ring. Ridge 76 has an inclined lower side surface and an essentially horizontal upper side surface, providing an engagement feature at the lower end 72 of the ring. The upper end 74 of each ring comprises an engagement feature which is a laterally extending lip 67. Thus when two like rings are mated as shown in FIG. 2, lip 67 forces the portion having ridge 76 radially outwardly and then ridge 76 of the lower end of a ring captures the lip 67 of upper end 74 of the underlying ring within the groove cavity 73, so that the rings stay securely connected at joint 75.

Figure 3B:
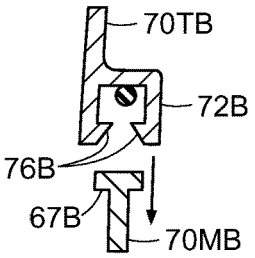
FIG. 3B is a detail like FIG. 3, showing an alternative joint engagement configuration.

The resilient nature of the plastics used for the rings, such as injection molded polyethylene or polypropylene, and the fit at the joints may be sufficient to obtain a water seal between the upper end and the lower end. Preferably, as shown in the detail view of FIG. 3, an O-ring 78 or other seal may run within groove 73 (or an associated sub-groove, not shown) to better ensure a seal when two rings are mated. In an alternative embodiment of joint engagement feature, illustrated by FIG. 3A, a ridge 76A runs around the inside of inner skirt 52 which with outer skirt 50 defines groove 73, and the lip 67A of the underlying mating ring faces inwardly rather than outwardly. FIG. 3B shows a third embodiment of joint. The joint fitting 72B at the lower end of ring 70TB has an engagement feature which comprises two ridges 76B which run around the interiors of the skirts on opposing sides of the groove of the joint fitting. The joint fitting 67B at the upper end of the ring 70MB comprises two laterally extending tabs, to engage with the ridges of the female joint fitting 72B; the fitting 67B is tee-shape in cross section. In other variations of the joint fitting within the groove, there may be two or more parallel ridges, and the ridges may be intermittent. The alternative engagement feature constructions illustrated by FIGS. 3, 3A and 3B and their variations should be understood to apply to and be useful in variations of the other embodiments of invention rings which are described below.

Tank 20 may be fitted with a lid which has a sealing surface or gasket in accord with the description of tank 120A which follows. See for instance FIG. 6A and the associated discussion. As described below, the flat surface at the top of the lip 67 of a ring 70 is adapted to engage the underside of a particularly configured lid and make a good seal; the lip 67 is adapted to optionally be engaged by joint engagement structure that is part of the lid.

Figure 3C:
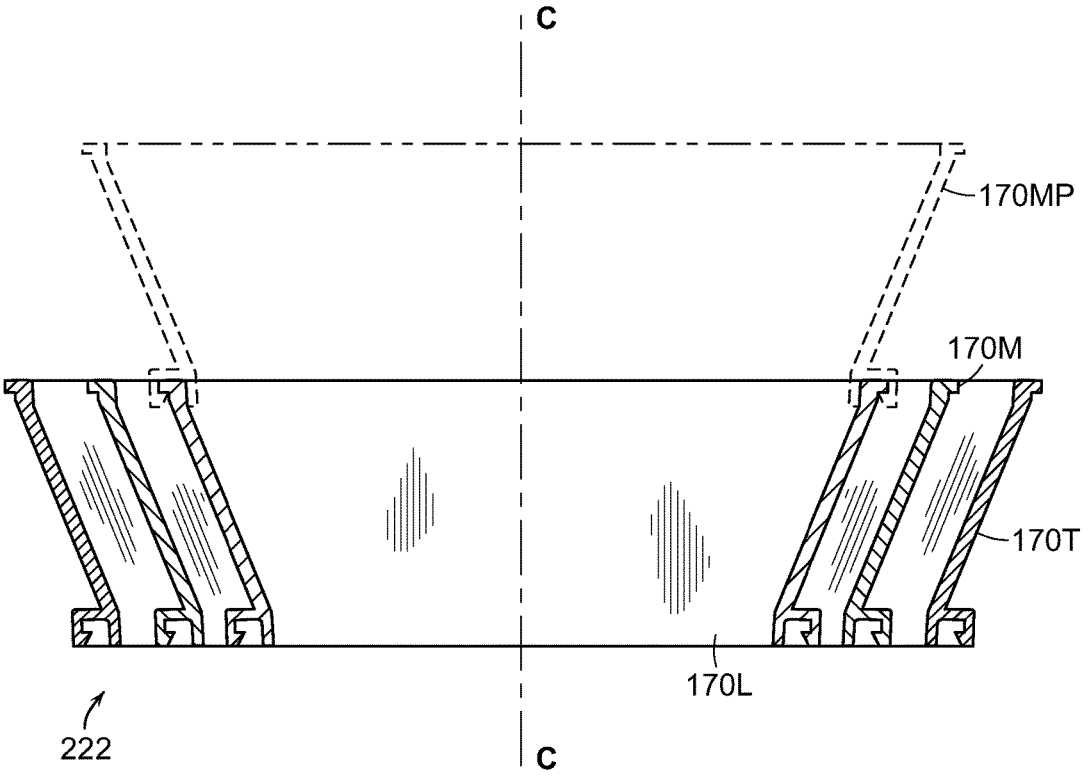
FIG. 3C is a cross section through three nested rings with can be mated to form a tank of the same style as the tank of FIG. 2. One of the rings is also shown in phantom, as it mounts on another ring.

While the joint design of the tank 20 shown in FIG. 1-3 provides advantage, each succeeding ring is necessarily larger in dimension than the underlying ring, and the top of tank 20 gets wider as more rings are added. The sequential rings of tank 20 will not nest well within one another, as pictured in FIG. 1 and FIG. 2. But when the slope of the sidewall of the rings is made less steep nesting can be accomplished. FIG. 3C shows in cross section three nested rings 170L, 170M, 170T of a tank (which correspond with the rings 70L, 70M, 70T insofar as order of assembly). The phantom 170MP of ring 170M shows how it connects to smaller ring 170L. When it is an objective that a riser have an upper end diameter that is not greatly different from the diameter of the bottom of the riser, a riser constructed in accord with tank 20 would not satisfy. And a tank made with rings like those shown in FIG. 2 and FIG. 3C requires that there be a multiplicity of different molds according to the maximum height of article which is sought. (While tank 20 and its variations have been described with the small diameter ring at the bottom of a tank, it is within comprehension that the wider end of an assembly can be fitted with a closure and placed downwardly on a support surface, wherein the tank will have a top opening smaller in diameter than the bottom of tank.)

Figure 4:
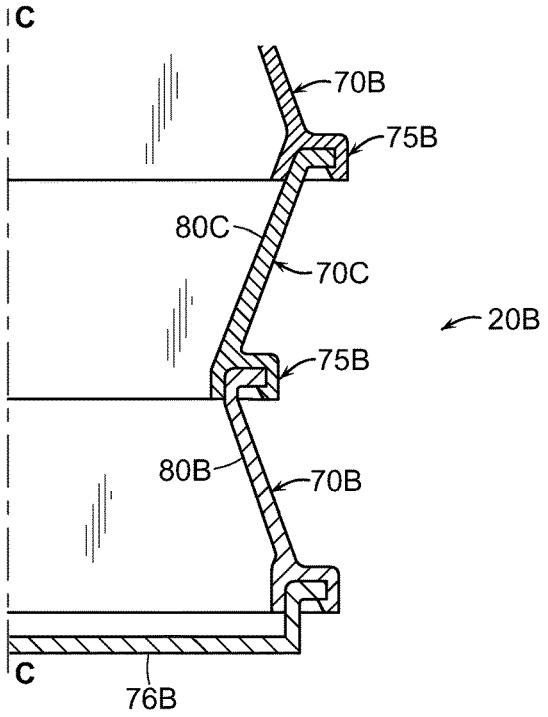
FIG. 4 is a partial vertical half-cross section of a tank, like FIG. 2, showing a tank having rings with alternating-slope walls.
Figure 4A:
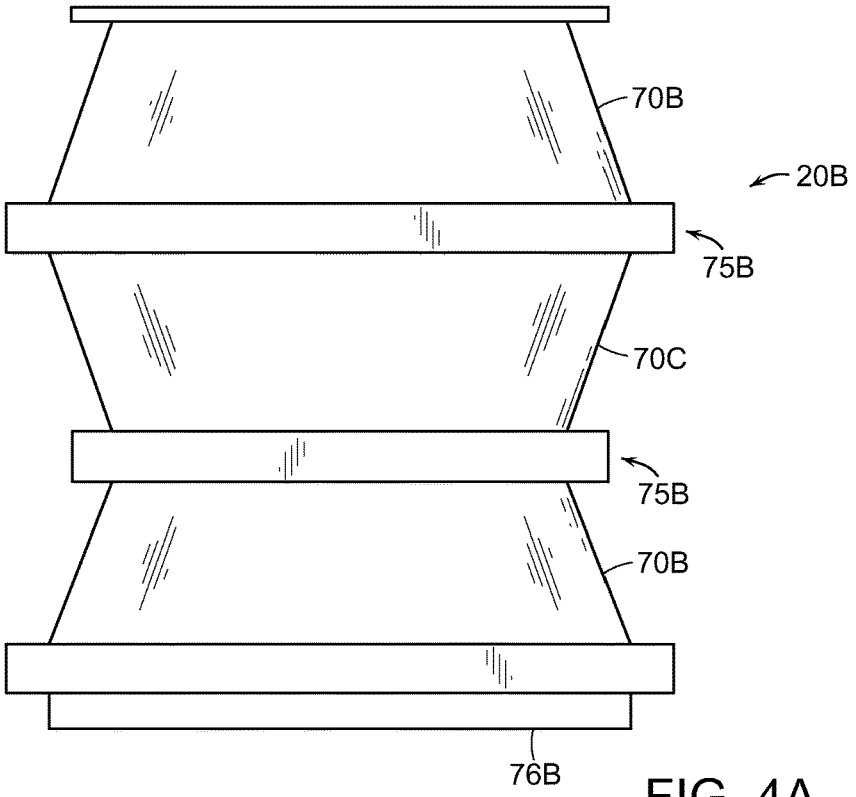
FIG. 4A is a side elevation view of the tank shown in FIG. 4.

FIG. 4 shows in partial vertical cross section a tank 20B which overcomes the aforementioned limitations of tank 20. FIG. 4A is a side elevation view of tank 20B. Tank 20B is comprised of two identical rings 70B, and one ring 70C. It will be appreciated from the following discussion that-a only two rings, or more than three rings, may comprise other embodiments. The rings 70B and 70C have respective walls 80B, 80C that are inclined from the vertical, for example, at a 10 to 20 degree angle. Exemplary ring 70B has an inward inclining conical wall 80B, while mating exemplary ring 70C has an outward inclining conical wall 80C. (Throughout, the term "conical" refers to what might be more technically called a truncated conical shape.) The exterior wall of tank assembly 20B or a related riser thus presents a vertically-undulating appearance, as is apparent in FIG. 4A. See also, related FIG. 6B. Alternatively, the wall of the tank may be characterized as having a zigzag in the vertical direction. The joints 75B of tank 20B are preferably similar to the joints 75 in tank 20. The rings of tank 20B will nest well with one another, as the following description will detail.

Figure 5:
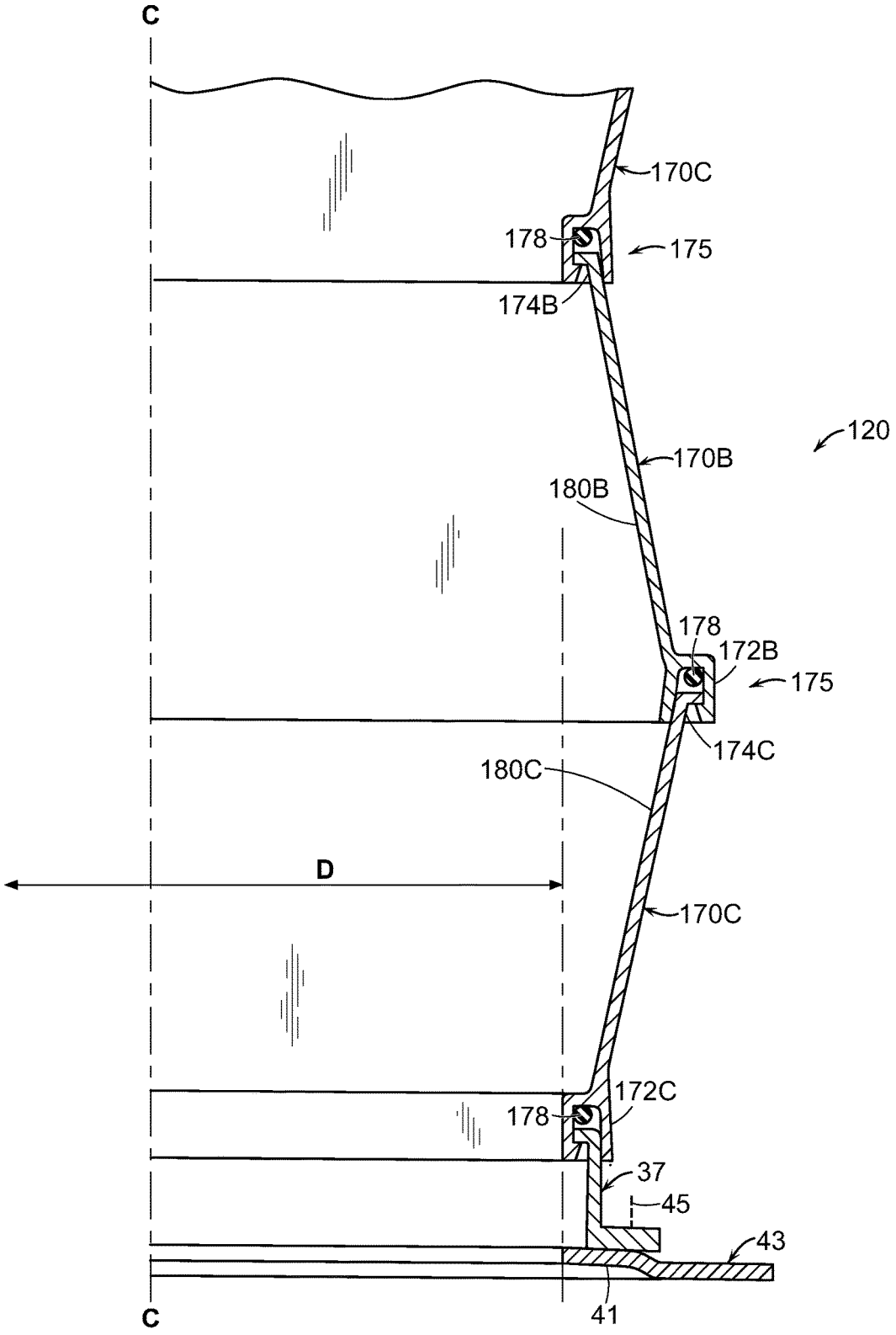
FIG. 5 is a partial vertical half-cross section of a riser comprised of a multiplicity of alternating-slope wall rings, along with a portion of a septic tank on which it is mounted, shown in phantom.
Figure 6:
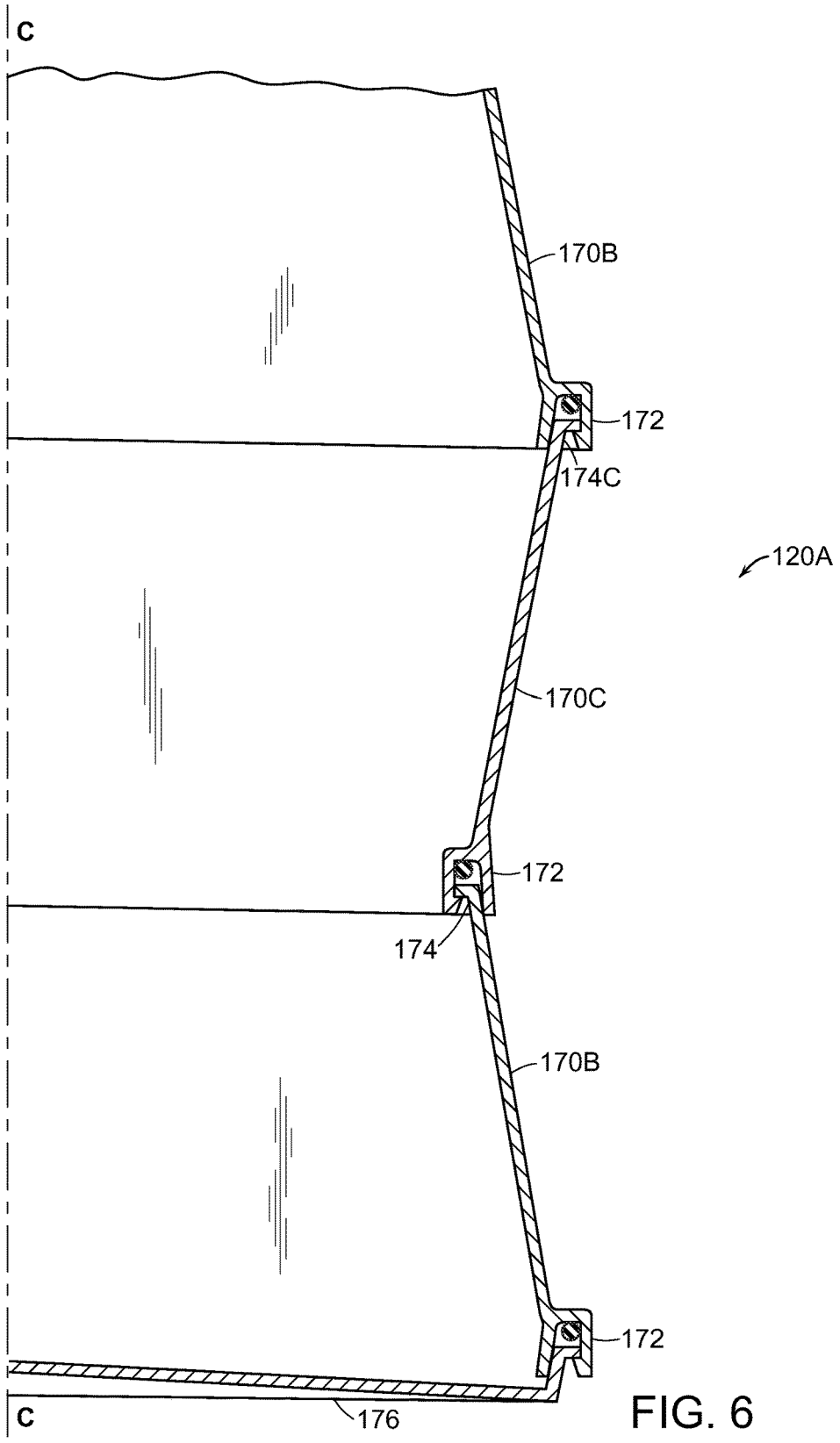
FIG. 6 is a partial vertical half-cross section of a tank comprised of a multiplicity of sloped-wall rings like those shown in FIG. 5, further including a closure at the bottom.

FIG. 5 shows a cross section portion of a circular riser 120 that has zigzag wall construction like tank 20B in combination with portions of a septic tank, shown in phantom. FIG. 6 shows a portion of a water storage tank 120A. Each structure 120, 120A comprises ring pairs having the same configuration. The difference is that; tank 120A has a disk-like bottom closure and riser 120 has an open bottom.

Figure 7:
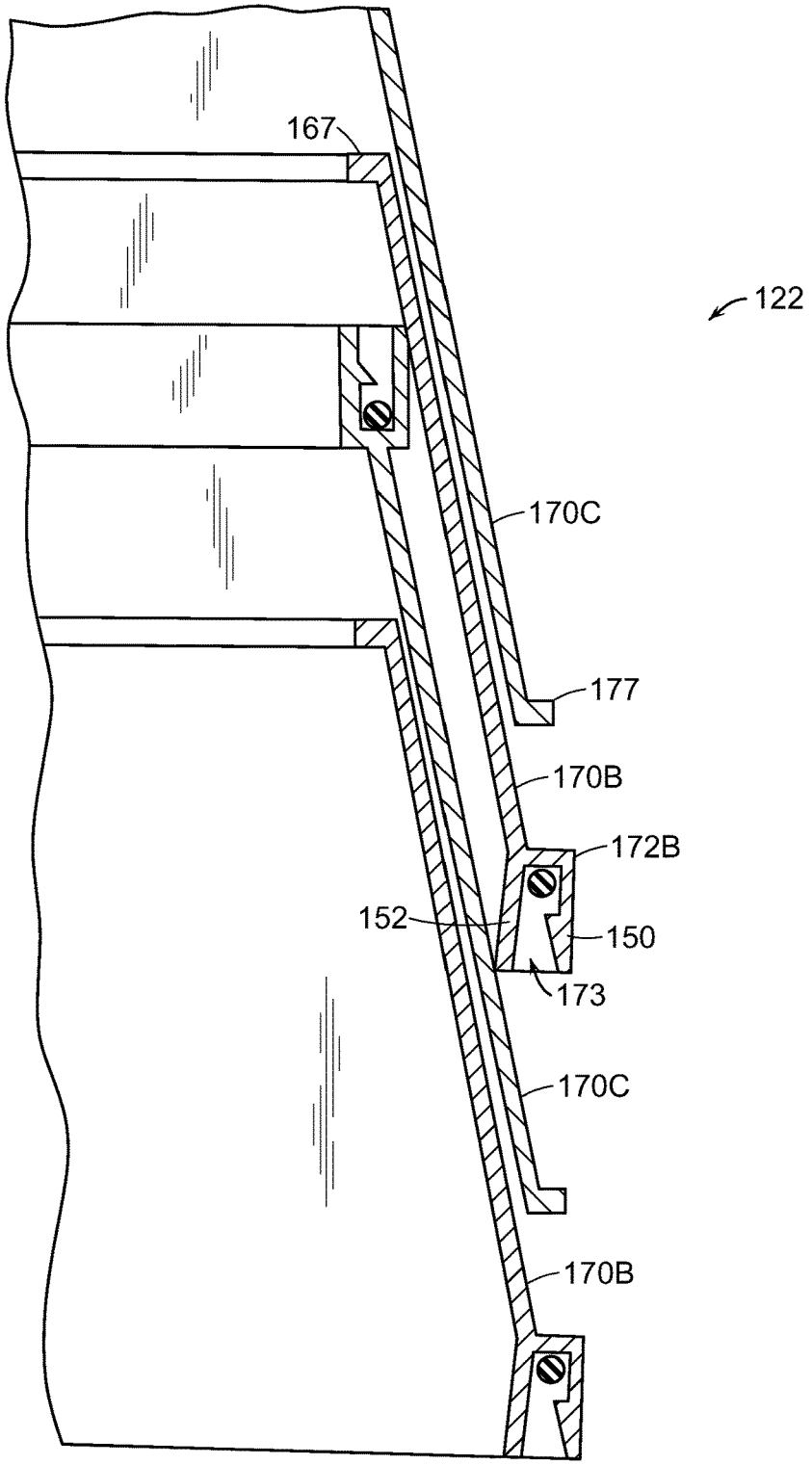
FIG. 7 is a vertical half-cross section showing the rings of the FIG. 5 and FIG. 6 devices in disassembled and nested fashion, ready for shipment or storage as a kit.

FIG. 5 shows how riser 120 may attach by means of lower end 172C to a circular adapter 37 which is fastened (by unshown screws which spaced apart around screw circle 45) to the flange 41 of a round access opening or port at the top of a septic tank 43, all shown in phantom. Tank 120A of FIG. 6 has a closure 176 attached to the lower end 172 of the bottom ring, so the assembly can store liquid. In an alternate embodiment of the tank 120A, bottom ring may be formed differently, with a bottom disk which is integral with the vertical wall of a special ring used only for bottom purpose. FIG. 7, discussed below, shows somewhat more definitively the joint fittings, than do the assembly drawings.

In accord with the features referred to in connection with FIG. 2-4, within the grooves 173 of the lower ends 172B, 172C of each of the rings of assemblies 120, 120A are O-ring seals 178, to seal the joints 175. See FIG. 7 and how a groove 173 is defined by inner skirt 152 and radially spaced apart outer skirt 150 at end 172B of a typical ring 170B. The respective conical walls 180B, 180C of exemplary rings 170B, 170C slope at about 10 degrees from the central axis C-C of a riser/tank assembly (or the corresponding axis of an individual ring). In other embodiments the walls may have a slope of 10-20 degrees, preferably. As with tank 20B, it will be appreciated that in riser 120 and tank 120B, there are two essential rings constructions: One kind of ring 170B has a conical body which tapers inwardly relative to the central axis C-C in the vertical direction; the other kind of ring 170C has a conical wall which tapers outwardly relative to the central axis C-C in the vertical direction. FIG. 7 shows riser 120 in knocked down condition: The rings 170B, 170C are in the form of a nested group 122 of rings and will be shipped as a kit along with any closures or lids. It will be appreciated from FIG. 7 that the group 122 of disassembled rings can be shipped in economic fashion, compared to shipping the same shape and size tank if it were of one-piece welded construction, or compared to a tank made of non-nestable rings in accord with prior art.

Figure 6A:
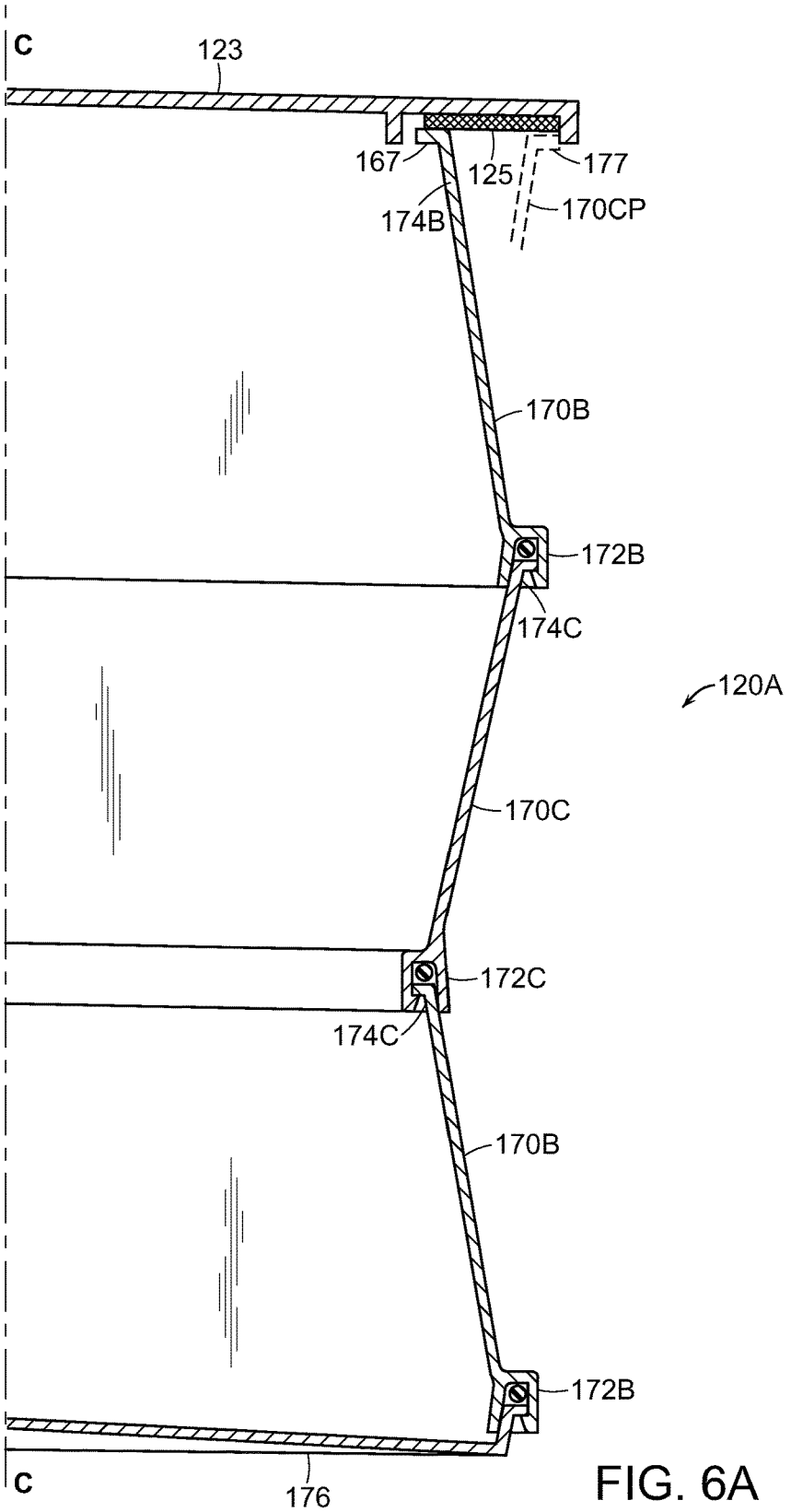
FIG. 6A shows the tank assembly of FIG. 6 with the addition of a lid.
Figure 6B:
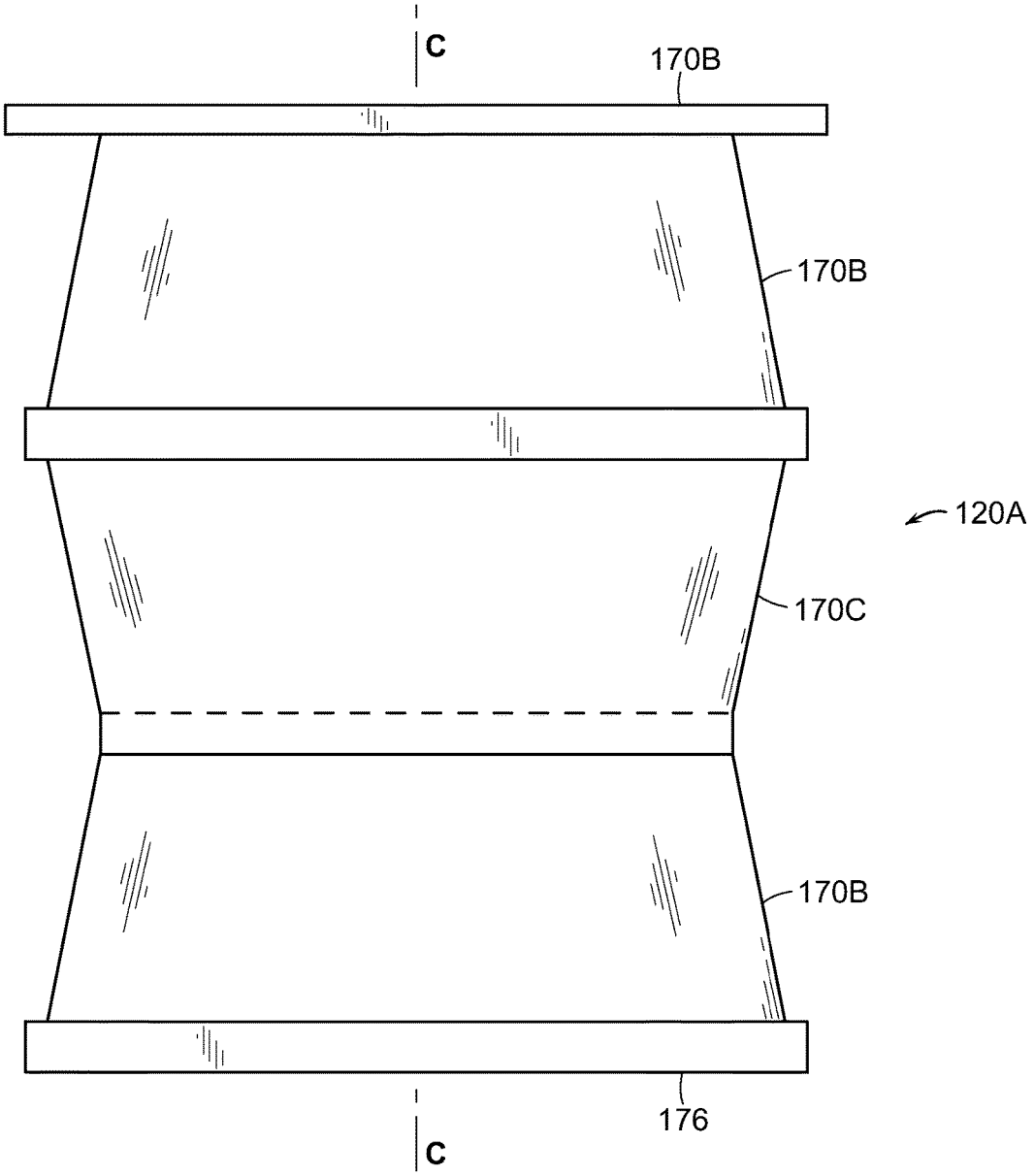
FIG. 6B is a side elevation view of the tank assembly of FIG. 6.

FIG. 6A also shows the tank 120A with the addition of a lid 123 on the upper end 174B of the topmost ring 170B. The lid has a flat gasket 125, preferably made of neoprene or other resilient material in the seal region of the lid, that is, at the portion of the lid that is shaped to mate with the flat upper surface of the joint fitting (inward-running lip) 167 at the upper end 174B of inwardly sloping ring 170B. The seal region and associated gasket of the lid have a radial width that is sufficient to mate also with the flat upper surface of the joint fitting (outward-running lip 177) of outward sloping ring 170C, shown as phantom 170CP. FIG. 6B is a side elevation view of tank 120A showing the undulation characteristic of rings having sidewall which slope at an about 10 degree angle to the vertical axis of the ring.

Preferably, in a riser application, the rings are used as pairs, that is, a bottom ring tapering inwardly is used in combination with an upper ring which tapers outwardly, so the top opening of the riser is the same diameter as the bottom opening. Nonetheless, the rings may be used singly or in threes, etc., according to the desire of the user and the kind of lid which is available.

While the rings of the present invention have been shown with the groove facing down and the mating lip end facing up, the appellations "upper end" and "lower end" are for convenience of description here and are not limitations. In the generality of the invention, the groove end can face upwardly and the lip end can face downwardly in an assembly which comprises a riser or water storage tank. At the same time, it is preferred that the groove face downwardly because it is less prone to receive and retain soil or other foreign material.

When the present invention is used as a riser, it is desirable to enable placement of a lid which will keep soil from entering the interior of the riser from the top opening. In one approach, a lid may fit on the topmost ring the same way as would another ring; for example, the lid may have a downward extending groove to receive the upward extending lip-end of the topmost ring of a riser. However, dirt could enter such a groove and interfere with the joint and sealing.

Figure 8:
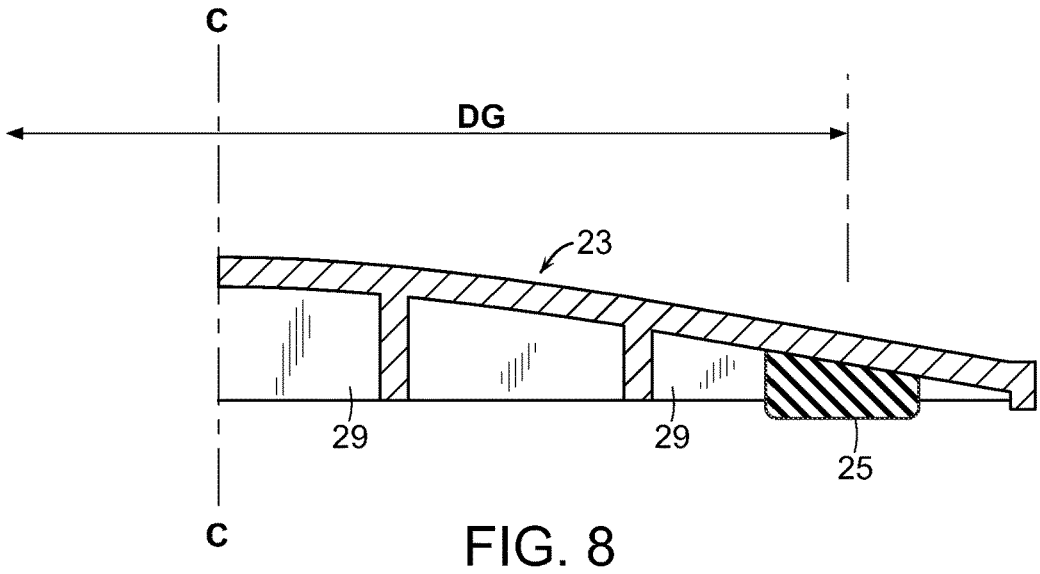
FIG. 8 is a vertical half-cross section showing a lid suitable for mounting on the top of a riser, or alternatively on the opening of a septic tank.
Figure 9:
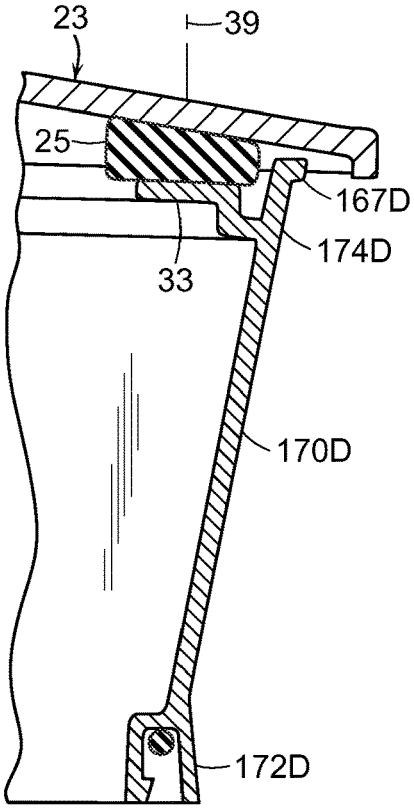
FIG. 9 is a vertical part-cross section showing the lid of FIG. 8 mounted on an outward-sloping-wall ring having an inward-extending flange suited for mating with the seal of the lid.
Figure 10:
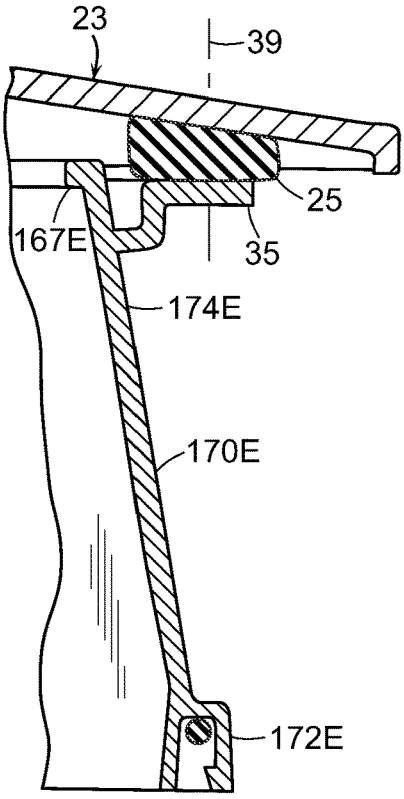
FIG. 10 is a vertical part-cross section showing the lid of FIG. 8 mounted on an inward-sloping-wall ring having an outward-extending flange suited for mating with the seal of the lid.

FIG. 9 and FIG. 10 show a further embodiment of ring which enables use of a conventional type of lid having a seal region which comprises a circular gasket shaped for mating with a substantially flat surface. FIG. 8 is a vertical half-cross section through the lid 23 of a septic tank. Lid 23 has strengthening ribs 29 and a generally flat circular gasket 25 with a nominal diameter DG. The lid is of the type that is associated with prior art risers and attaching directly to the flange of an access opening of a septic tank. FIG. 9 and FIG. 10 show alternative embodiment rings 170D, 170E which have integral flanges shaped to receive a flat gasket that is associated with a typical prior art kind of lid.

In FIG. 9 the upper portion of joint fitting portion of outwardly tapering ring 170D has an inward extending flange 33 that receives gasket 25 which is affixed to the underside of lid 23. The lid may be secured to the ring by means of a screw fasteners running through the lid and flange at screw circle 39. Preferably, the inward extension of interior extending flange 33 of ring 170D is such that the opening at the flange elevation is at least as great in diameter as the opening diameter D which is presented at the small end 172D of a ring, as is shown in FIG. 5.

In FIG. 10 the upper portion of exemplary inwardly tapering ring 170E has an outward extending flange 35 that is at the same radial distance from the centerline C-C of the ring 170E as flange 33 of ring 170D is from its corresponding ring centerline C-C. Thus, the same location of the seal surface/gasket of lid 23 mates with both the flange 35 and the flange 33, to make a seal when the lid is secured to the riser ring.

In rings 170D, 170E, the upper end of the end of the ring is shaped for a choice of engagement with another ring or with a lid having a flat gasket. Thus the circular lip 167D of ring 170D will fit in the circular cavity or groove of the lower end 172E of ring 170E; and the circular lip 167E of ring 170E will fit in the circular cavity or groove of the lower end 172D of ring 170D.

Figure 11:
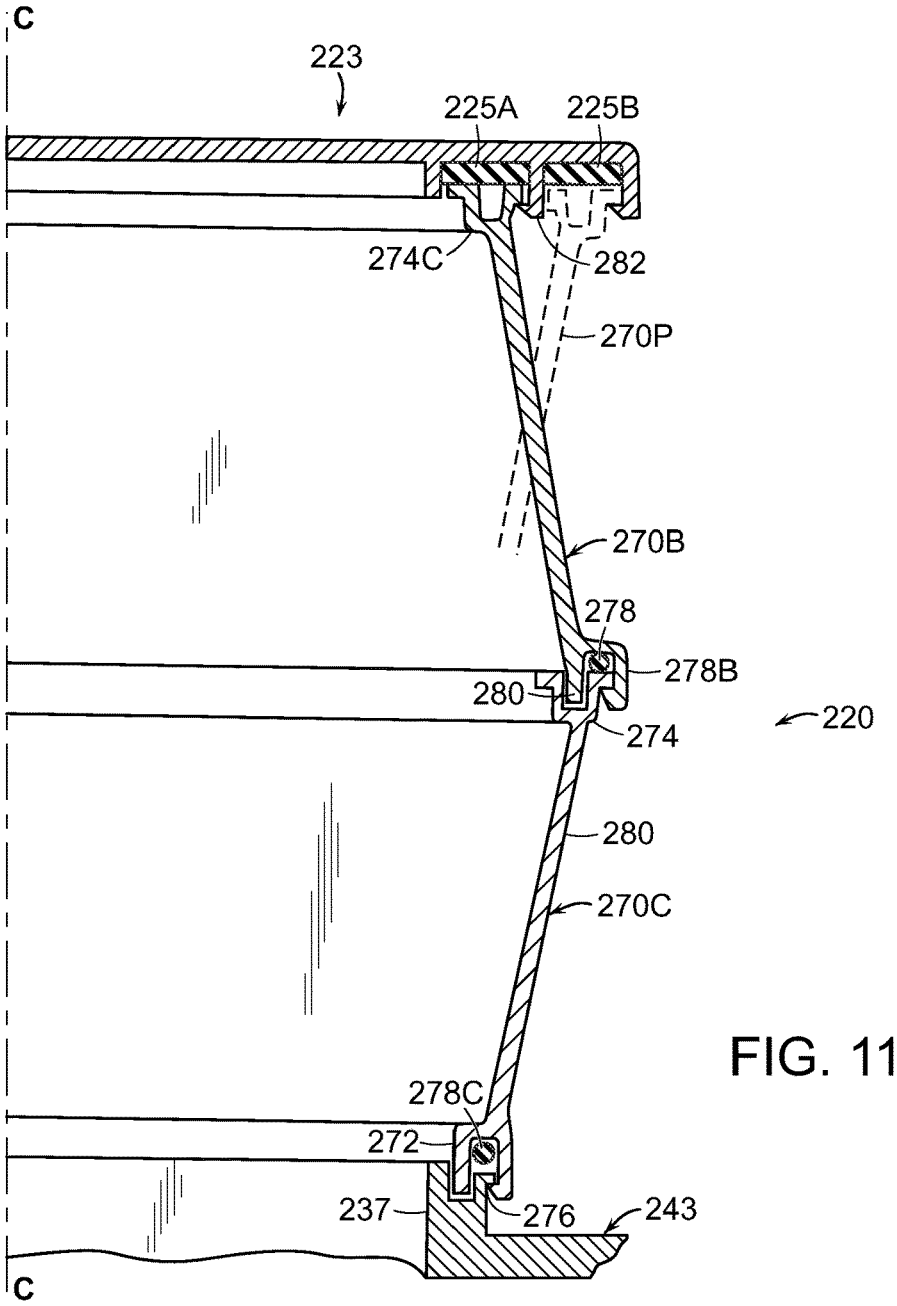
FIG. 11 is a vertical half-cross section of a riser comprised of a multiplicity of alternating-slope conical wall rings, along with a portion of a septic tank and a portion of a lid.
Figure 12:
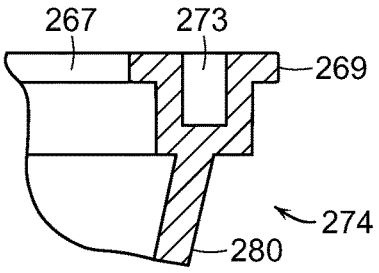
FIG. 12 is a detail view of an upper end of one of the rings shown in FIG. 11.

FIG. 11 shows riser 220 which has different configuration joints between rings of a riser, along with a portion of a lid and a septic tank. Riser 220 is shown in mounted position on the rim 237 associated with the port opening at the top of septic tank 243. The upper end of each conical ring 270C, 270B is suited for alternatively mating with an overlying ring or for receiving a circular gasket of a lid 223. FIG. 12 details the configuration of typical upper end 274.

First ring 270C has an outwardly tapering conical wall 280, a lower end 272 which has a circular groove in which is contained O-ring seal 278, and an upper end 274 which receives the lower end 278B of inwardly tapering conical second ring 270B which has an upper end 274C. The lower ends 278B, 278C of each ring have a downward facing straight-sided groove with an associated circumscribing ridge that elastically engages a circumscribing lip of the mating underlying ring. For example typical ridge 276 shown in FIG. 11 is shaped to engage a lip such as lip 269 as detailed in FIG. 12. The lower end of each ring has a downwardly extending straight sided circular collar that is receivable in the upward facing circular groove of the upper end of each underlying ring. For example collar 280 of ring 270B is received in groove 273 of upper end 274. As shown by the example of upper end 274, each upper end has a flat circular surface on either side of the groove. The flat surface enables good sealing contact with the gasket of a lid put onto the uppermost ring.

Figure 13:
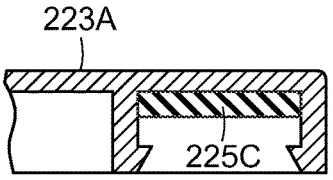
FIG. 13 is a detail view of an alternative configuration lid for use with the assembly of FIG. 12.

Lid 223 has two adjacent seal regions where there are flat circular gaskets made of resilient material, such as neoprene rubber, namely inner gasket 225A and outer gasket 225B. The seal regions are spaced apart by a ridge 282 which preferably has an engagement feature such as the ridge which is shown. Optionally, there may be no gaskets within the lid at the seal region. FIG. 11 shows how the upper end of inwardly tapering ring 270B mates with the inner gasket and a seal is formed. As shown by the phantom ring 270P, the outer gasket 225B of lid 223 sealingly mates with the upper end of an outwardly tapering ring when such ring it uppermost ring in an assembly. FIG. 13 is a detail of the outer portion of an alternative embodiment lid 223A wherein the seal region and associated gasket is unitary. In the generality of the present invention a lid may or may not have engagement features for latching onto the upper end of a ring.

Other configuration joints may be used between mated rings in alternative embodiments of the invention, particularly including joints shown in a commonly owned patent application entitled "Molded plastic water storage tanks" being filed contemporaneously on Jul. 28, 2014 with this application by the same applicant, bearing Ser. No. 14/444,831 and claiming benefit from provisional application Ser. No. 61/858,757, filed Jul. 26, 2013. The disclosures of said related applications are hereby incorporated by reference.

The invention, with explicit and implicit variations and advantages, has been described and illustrated with respect to several embodiments. Those embodiments should be considered illustrative and not restrictive. Any use of words such as "preferred" and variations suggest a feature or combination which is desirable but which is not necessarily mandatory. Thus embodiments lacking any such preferred feature or combination may be within the scope of the claims which follow. Persons skilled in the art may make various changes in form and detail of the invention embodiments which are described, without departing from the spirit and scope of the claimed invention.

What is claimed is:

1. A riser ring assembly having an undulating wall in a riser lengthwise direction, for use on a buried water holding tank or water treatment tank, comprised of a first riser ring having a central length axis, a first end, and a second end, said ends spaced apart along the central length axis, wherein each said end is circular and has a respective diameter, and wherein the second end diameter is smaller in dimension than the first end diameter, the first riser ring comprising:

a conical wall running lengthwise from the first end to the second end;

a first joint fitting, at the first end, comprising a first skirt and a second skirt, both running circumferentially, the second skirt having a larger circumference than the first skirt, the skirts radially spaced apart from each other thereby defining a circular groove facing in the lengthwise direction of the riser ring;

a circumferential ridge on the second skirt, the ridge running radially inwardly within the groove in a direction toward said central length axis; and, a second joint fitting, at said second end, comprising a lip extending radially inwardly from said conical wall; and, a second riser ring having a central length axis, a first end and a second end, said ends spaced apart along the central length axis, wherein each said end is circular and has a respective diameter, and wherein the second end diameter is larger in dimension than the first end diameter, comprising:

a conical wall running lengthwise from the first end to the second end;

a first joint fitting, at the first end, comprising a first skirt and a second skirt, both running circumferentially; the second skirt having a smaller circumference than the first skirt, the skirts radially spaced apart from each other thereby defining a circular groove facing in the lengthwise direction of the riser ring;

a circumferential ridge on the second skirt, the ridge running radially outwardly within the groove in a direction toward said central length axis; and, a second joint fitting at said second end comprising a lip extending radially outwardly from said conical wall:

wherein the second end of the first riser ring and the first end of the second riser ring are connected together at a joint wherein the lip of the second joint fitting of the first riser ring is positioned within the circular groove of the second ring and said lip is engaged with the circumferential ridge within said circular groove of the second riser ring, to thereby hinder the first riser ring and the second riser ring from disconnecting.

2. The riser assembly of claim 1, further comprising a third riser ring that is identical to the first riser ring, wherein the second end of the third riser ring and the second end of the second riser ring are connected together at a joint, wherein the lip of the second riser ring is positioned within the circular groove of the third riser ring and is engaged with the circumferential ridge within the circular groove of the third riser ring.

3. The riser assembly of claim 1, further comprising a third riser ring that is identical to the second riser ring, wherein the second end of the third riser ring and the first end of the first riser ring are connected together at a joint, wherein the lip of the second joint fitting of the third riser ring is positioned within the circular groove of the first riser ring and said lip is engaged with the circumferential ridge within the circular groove of the first riser ring.

4. The assembly of claim 1 further comprising a seal within the circular groove of the first joint fitting of the second ring.

5. The assembly of claim 2 further comprising a seal within the circular groove of the first joint fitting of the first riser ring.

6. The assembly of claim 1 wherein each riser ring is made of plastic and wherein the conical wall of each riser ring respectively slopes at 10 to 20 degrees to the central length axis of the riser ring.

7. A riser assembly having an undulating wall in a riser lengthwise direction for use on a buried water holding tank or water treatment tank, comprised of a first riser ring having a central length axis, a first end, and a second end, said ends spaced apart along the central length axis, wherein each said end is circular and has a respective diameter, and wherein the second end diameter is smaller in dimension than the first end diameter, the first riser ring comprising:

a conical wall running lengthwise from the first end to the second end;

a first joint fitting, at the first end, comprising a first skirt and a second skirt, both running circumferentially, the second skirt having a larger circumference than the first skirt, the skirts radially spaced apart from each other thereby defining a circular groove facing in the lengthwise direction of the riser ring;

a circumferential ridge on the second skirt, the ridge running radially inwardly within the groove in a direction toward said central length axis; and, a second joint fitting, at said second end, comprising a lip extending radially inwardly from said conical wall; and, a second riser ring having a central length axis, a first end and a second end, said ends spaced apart along the central length axis, wherein each said end is circular and has a respective diameter, and wherein the second end diameter is larger in dimension than the first end diameter, comprising:

a conical wall running lengthwise from the first end to the second end;

a first joint fitting, at the first end, comprising a first skirt and a second skirt, both running circumferentially; the second skirt having a smaller circumference than the first skirt, the skirts radially spaced apart from each other thereby defining a circular groove facing in the lengthwise direction of the riser ring; and, a circumferential ridge on the second skirt, the ridge running radially outwardly within the groove in a direction toward said central length axis; and, a second joint fitting at said second end comprising a lip extending radially outwardly from said conical wall:

wherein the first end of the first riser ring and the second end of the second riser ring are connected together at a joint wherein the lip of the second riser ring is positioned within the circular groove of the first riser ring and said lip is engaged with the circumferential ridge within said circular groove of the first riser ring.

8. The assembly of claim 7 further comprising a seal within the circular groove of the first joint fitting of the first riser ring.

9. The assembly of claim 7 wherein each riser ring is made of plastic, and wherein the conical wall of each riser ring respectively slopes at 10 to 20 degrees to the central length axis of the riser ring.

* * * * *